United States Patent [19]

Davisson

[11] Patent Number: 4,796,811

[45] Date of Patent: Jan. 10, 1989

[54] SPRINKLER HAVING A FLOW RATE COMPENSATING SLOW SPEED ROTARY DISTRIBUTOR

[75] Inventor: Paul D. Davisson, Walla Walla, Wash.

[73] Assignee: Nelson Irrigation Corporation, Walla Walla, Wash.

[21] Appl. No.: 180,448

[22] Filed: Apr. 12, 1988

[51] Int. Cl.[4] ..... B05B 3/06

[52] U.S. Cl. ..... 239/222.17; 239/231; 239/381

[58] Field of Search ..... 239/222.11, 222.17, 239/222.21, 223, 224, 231, 251, 252, 380, 381

[56] References Cited

U.S. PATENT DOCUMENTS

| | | | |
|---|---|---|---|
| D. 259,438 | 6/1981 | Meyer | D23/35 |
| 458,607 | 9/1891 | Weiss . | |
| 581,252 | 4/1897 | Quayle | 239/222.21 X |
| 2,785,013 | 3/1957 | Stearns . | |
| 3,030,032 | 4/1962 | Luhman, Jr. | 239/222.17 |
| 4,091,996 | 5/1978 | Nelson | 239/230 X |
| 4,356,972 | 11/1982 | Vikre | 239/222.17 X |
| 4,405,085 | 9/1983 | Meyer . | |
| 4,440,345 | 4/1984 | Figwer et al. | 239/252 X |
| 4,560,108 | 12/1985 | Rubinstein | 239/222.17 |
| 4,660,766 | 4/1987 | Nelson | 239/222.17 |

FOREIGN PATENT DOCUMENTS

| | | | |
|---|---|---|---|
| 934448 | 5/1948 | France | 239/222.17 |
| 1100119 | 9/1955 | France | 239/222.17 |
| 1101783 | 10/1955 | France | 239/222.17 |
| 15055 | of 1896 | United Kingdom | 239/222.17 |

*Primary Examiner*—Andres Kashnikow
*Assistant Examiner*—Mary Beth O. Jones
*Attorney, Agent, or Firm*—Cushman, Darby & Cushman

[57] ABSTRACT

A rotary sprinkler head comprising a sprinkler body having an outlet defined by a selected nozzle for directing water under pressure communicated therewith into an atmospheric condition in a primary stream having a generally vertically extending axis. A rotary distributor is mounted for rotational movement about a generally vertical rotational axis with respect to said sprinkler body in engaging relation with respect to the primary stream directed from said nozzle so as to be rotated thereby. A speed reducer is provided to slow the rotational speed imparted to the distributor. The distributor has surfaces for directing the primary stream outwardly in such a way as to create reactionary forces having net components acting tangentially to the axis of rotation of the distributor which do not increase substantially with increases in flow rates under constant pressure conditions thereby enabling the distributor to operate with a relatively narrow range of rotational speed changes within a relatively wide range of nozzle size changes.

22 Claims, 6 Drawing Sheets

SPRINKLER HAVING A FLOW RATE COMPENSATING SLOW SPEED ROTARY DISTRIBUTOR

This invention relates to water distrivution for irrigation purposes and, more particularly, to sprinkler heads of the type disclosed in U.S. Pat. No. 4,660,766.

Ths sprinkler head disclosed in the aforesaid patent includes a sprinkler body or housing having an inlet which is adapted to be connected to a source of water under pressure by a static seal and an outlet. The oulet is defined by a nozzle which directs the water under pressure communicating with the sprinkler body as a primary stream into the atmosphere along a generally vertically extending axis. A rotary distribution is provided for receiving the primary stream and directing it outwardly onto a circular water distribution pattern. A speed reducer or damper is provided for reducing the rotational speed of the distribution resulting from the relatively high whirling speed which would occur without the speed reducer to a relatively slow speed.

There are three particular advantages that are obtained by this type of sprinkler head. The basic advantage is that the sprinkler head can be produced in a cost effective manner. The primary operational advantage is that the water under pressure is handled in such a way that there is no necessity of providing any operative dynamic seals which can easily wear put. The second operational advantage is that by limiting the rotational speed, the water contacting the rotary distributor can be projected outwardly so that stream integrity exists beyond the rotary distributor. Thus, the water distribution pattern can be made to closely simulate the highly desirable water distribution pattern of an impact sprinkler head. This basically desirable result, in terms of water pattern size and water distribution within the pattern is not possible with other sprinker heads of the type which utilize a vertical nozzle directed atmospheric primary stream and either a stationary distributor or a high speed rotary distributor for distributing the primary stream.

As is disclosed in the aforesaid patent, in order to project the water from the slow speed distributor with some stream integrity, the distributor is provided with surfaces for receiving the primary stream and directing it outwardly. In one embodiment, the conical surface of the distributor is formed with two stream directing grooves which intersect along the axis of the primary stream so that the primary stream is initially divided into two separate streams. The grooves extend radially outwardly from the axis of rotation and have a curvature toward their outer ends which create net tangentially directed reactionary forces imparting rotational movement to the distributor by virtue of the water moving in contact with the curved surfaces provided. This groove type construction of the water directing surface means of the slow speed rotary distributor has two limitations. The first is that the configuration of the grooves inherently tend to cause debris, either extraneous or in the primary stream, from hanging up on the distributor and thus severely altering the distribution pattern perhaps even with damaging effects if the rotational speed is stopped altogether. Second, with the curvature of the groove provided for purposes of achieving rotation, the rotational speed of the distributor increases substantially as nozzle sizes are increased. For example, when sprinkler heads of this type are utilized in a pivot move system there is required a range of sprinkler head nozzle sizes throughout the radial extent of the pivot move system. Heretofore, it had not been possible to provide a single rotary distributor capable of operating effectively with all of the different nozzle sizes within the total range required.

An object of the present invention is to provide a rotary sprinkler head of the type described which has a slow speed rotary distributor having surface means for distributing water from the primary stream in such a way as to enable the distributor to operate within a relatively narrow range of rotational speed changes within a relatively wide range of nozzle size changes to an extent sufficient to enable a single rotary distributor to accommodate all of the sprinkler head requirements in a single pivot move system exclusive of the end gun. In accordance with the principles of the present invention, this object is accomplished by providing the rotary distributor with surfaces for receiving the primary stream, dividing the primary stream into a plurality of horizontally separated streams, each having a major vertical component of movement and a minor horizontal component of movement, and directing the separated streams while maintaining the integrity of the streams in a plurality of generally equally annularly spaced directions outwardly of the vertical axis of the primary stream so that (1) the separated streams leave the distributor surfaces with a minor vertical component and a major horizontal component of stream movement and (2) the change in the components of movements of the streams create reactionary forces having net components acting tangentially to the rotational axis of the distributor which do not increase substantially with increases in flow rates under constant pressure conditions. In this way, changes in the size of the stream by changes in the nozzle size do not have a substantial effect on the speed as is the case with the groove configuration disclosed in the aforesaid patent where the surface curvature which establishes the net tangential reactionary forces are contacted by all of the water at positions spaced substantially from the axis so as to act through relatively large lever arms.

Another object of the present invention is the provision of a rotary sprinkler head of the type described which is constructed so as to minimize the possibility of extraneous debris and/or debris within the primary stream from hanging up on the distributor and detrimentally altering the desired water distribution pattern thereof. In accordance with the principles of the present invention, this objective is obtained by insuring that the surfaces of the distributor define surface shapes devoid of extended shapes disposed in directions facing towards the instantaneous direction of water flow contacted thereby. Preferably, the portions of the distributor surfaces which receive the primary stream and divide the primary stream into a plurality of horizontally separated streams define a central point along the vertical axis of rotation of the distributor constituting the closest distributor surface to the nozzle defining the primary stream and a plurality of relatively sharp edges are defined which face toward the nozzle having innermost ends disposed closely adjacent the central point. Each of the plurality of relatively sharp edges extends continuously and smoothly from the innermost end thereof in a direction away from the nozzle and away from the vertical axis of rotation.

The principles of the present invention insofar as minimizing debris hang up is concerned are applicable to high speed spinning type water distributors, examples of which are disclosed in the following U.S. Pat. Nos. 458,607, 2,785,013, 4,560,108, and 4,356,972. A distributor according to the present invention is preferably used in the combination of components disclosed in the aforesaid U.S. Pat. No. 4,660,766, where relative low turning speeds are encountered in operation in order to maintain stream integrity after leaving the distributor. In slow speed operation, control of speed increases in response to increases in the nozzle size utilized is important. The present distributor can be used in the prior art combinations exemplified above where the advantage of minimizing debris hang up can be obtained even though the distributor will turn at higher speeds with the resultant immediate breakup of stream integrity and change in pattern size and distribution.

Another object of the present invention is the provision of a sprinkler head of the type described which is simple in construction, effective in operation, and economical to manufacture and maintain.

The invention may best be understood with reference to the accompanying drawings wherein an illustrative embodiment is shown.

IN THE DRAWINGS

Figure 1:
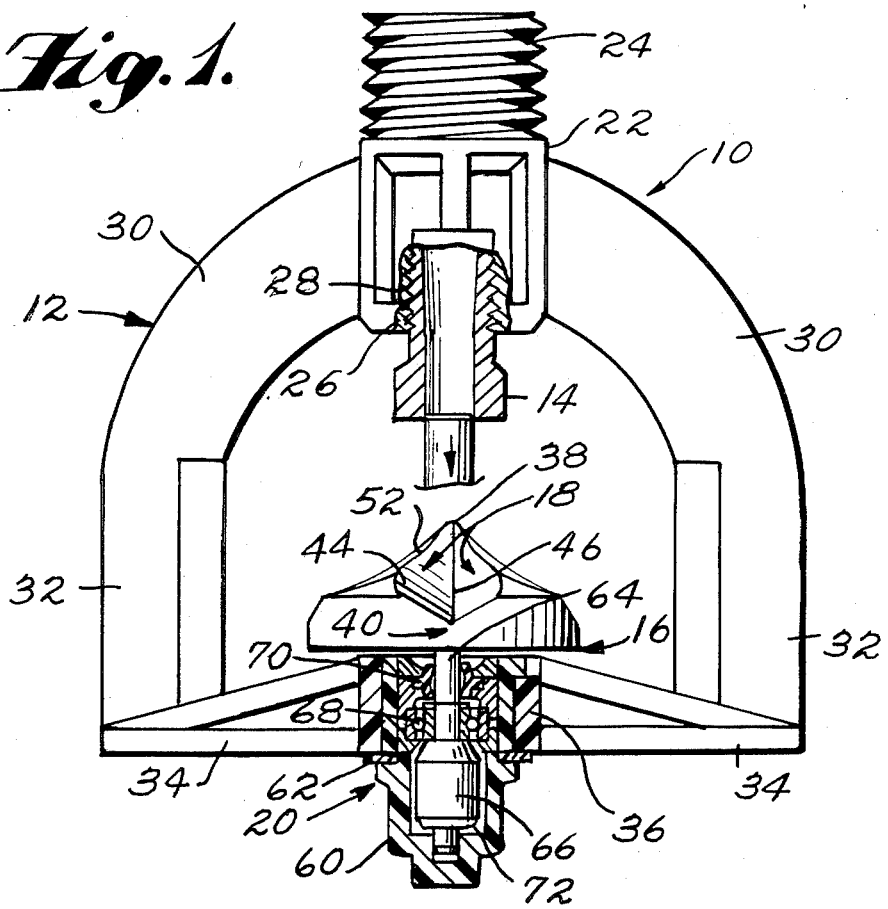
FIG. 1 is a front elevational view of a sprinkler head embodying the principles of the present invention with certain parts shown in vertical section for purposes of clear illustration.

Referring now more particularly to the drawings, there is shown in FIGS. 1–6 one embodiment of a sprinkler head, generally indicated at 10, which embodies the principles of the present invention. In general, the sprinkler head includes a sprinkler body, generally indicated at 12, which as shown, is a static structure adapted to be connected to a source of water under pressure. An outlet nozzle 14 is positioned on the sprinkler body 12 so as to direct the source of water under pressure into an atmospheric condition at the site to be sprinkled in a primary stream having a generally vertically extending axis. The sprinkler head 10 also includes a rotary distributor, generally indicated at 16, which is mounted for rotational movement about a rotational axis which preferably is concentric with the vertical axis of the primary stream. The rotary distributor 16 includes surface means, generally indicated at 18, for engaging the primary stream (1) to establish a reactionary force component acting on the distributor 16 in a direction tangential to the rotational axis thereof so as to effect rotational movement thereof about its rotational axis and (2) to direct the primary stream engaged thereby in the form of pattern forming stream means which includes at least one stream but preferably three or more streams moving away from the distributor 16 in a direction having a substantial component extending radially outwardly from the generally vertical axis of the primary stream. Finally, the rotary sprinkler head 10 also includes a speed reducing assembly 20 which is operatively associated with the rotary distributor 16 for reducing the rotational speed of the distributor 16 resulting from the reactionary force component from a relatively high whirling speed which would occur without the speed reducing assembly 20 to a relatively slow speed so related to the distributor surface means 18 forming the pattern forming stream or streams as to permit (1) the one stream or preferably three or more streams to leave the distributor surface means 18 with sufficient stream integrity to flow outwardly a distance substantially as great as the same would flow if the distributor 16 were held stationary and (2) the one stream or all of the pattern forming streams to be distributed within a generally circular pattern with a desired droplet size and with a desired water distribution within the generally circular pattern. The radius of the circular pattern is defined by the maximum extent of flow of the one stream or the preferably three or more streams.

In the embodiment shown in FIG. 1, the sprinkler body 12 takes the form of a known sprinkler body which is utilized in a spray head currently offered for sale on the market by the owner of the present application. The design of the sprinkler body of the spray head is substantially illustrated in commonly assigned U.S. Pat. No. Des. 259,438. The sprinkler body 12 constitutes a molding of plastic material as, for example, nylon. It will be understood that other suitable plastic materials may be utilized if desired. The sprinkler body 12 is molded to include a tubular inlet portion 22 which has exterior threads 24 for engaging within a conduit or the like (not shown) which contains a source of water under pressure. The interior of the tubular inlet portion 22 is provided with a series of annularly spaced longitudinally extending guide fins (not shown) which serve to smoothly direct the water to an adjacent tubular outlet portion 26 formed on the sprinkler body. The tubular outlet portion 26 is interiorly threaded, as indicated at 28, to receive a selected outlet nozzle 14. As shown, the outlet nozzle 14 is of conventional metal construction and is configured to direct the water under pressure entering the tubular inlet portion 22 into the atmospheric conditions at the site containing the pattern area to be sprinkled as a downwardly directed primary stream having a substantially vertical axis which is coincident with the axis of both the tubular inlet portion 22 and the tubular outlet portion 26.

The selected nozzle 14, as shown in FIG. 1, has an outlet size which is relatively small. It is an important aspect of the present invention that the surface means 18 is operable to effectively distribute the water in the primary stream through a relatively wide range of nozzles of increased outlet size without a substantial increase in speed. An operative range of outlet sizes is from 14/128 inches to 50/128 inches in diameter with a preferred range of 16/128 inches to 44/128 inches. The latter range enables a full length pivot move system to be equipped with a series of sprinkler heads 10 embodying the same components except for the selected nozzle size throughout except for the end gun. This capability not only reduces costs but provides a major convenience both to the pivot move manufacturer in initially setting up the pivot move system and to the farmer in maintenance. It will also be understood that the series of nozzles need not be of the fixed metal type but could embody the flow control resilient washer type nozzle disclosed in U.S. Pat. No. 4,091,996.

The particular sprinkler body 12 shown in FIGS. 1–6 provides a supporting depending structure for the rotary distributor 16. This supporting structure is in the form of a pair of integral mounting arm portions 30 which extend outwardly and downwardly from opposite sides of the tubular outlet portion 26. Extending downwardly from the arm portions 30 is a pair of parallel vertically extending strut portions 32, the lower ends of which are fixedly integrally interconnected by a pair of horizontally inwardly extending portions 34 interconnected by a tubular central mounting portion 36. The strut portions 32 of the sprinkler body 12 are disposed in a position to be engaged by the stream of the sprinkler head 10 and to minimize the effect of this engagement on the resulting distribution of water in the pattern area, the strut portions 32 have a stepped triangularly shaped tapered cross-sectional configuration.

The central tubular mounting portion 36 in the spray head depicted in the aforesaid design patent has mounted therein a stationary spray deflector plate. In accordance with the principles of the present invention, the combined rotary distributor 16 and associated speed reducing assembly 20 is arranged to be supported within the tubular mounting portion 36 in lieu of the fixed spray plate.

As previously indicated, an arrangement of the type described above wherein the spray head type sprinkler body is utilized and the primary stream established therein is directed downwardly finds particular use in moving irrigation systems, such as pivot move systems. As example of such a use is disclosed in commonly assigned U.S. Pat. No. 4,405,085 wherein the spray heads 22 shown therein could readily be replaced by rotary sprinkler heads 10 of the present invention, such as illustrated in FIGS. 1–6.

It will be understood, however, that the sprinkler head 10 of the present invention may be readily adapted for use in any sprinkler set-up where either rotary impact sprinkler heads have been previously used or where spray heads have been recently used in place of impacts. The rotary sprinkler head 10 of the present invention achieves satisfactory operation at lower pressures than conventional rotary impact sprinkler heads and achieves a more desirable and extensive spray pattern than can be achieved with a comparably sized spray head. U.S. Pat. No. 4,405,085 discloses the mounting of spray heads on booms supported by drop tubes from the elevated conduit of a pivot move or lateral move irrigation system. The rotary sprinkler heads 10 of the present invention would be particularly useful with drop tubes and/or booms in the configuration as depicted in FIGS. 1–6.

The present invention is more particularly concerned with the configuration of the surface means 18 of the rotary distributor 16. As shown, the surface means provides a relatively small central cone 38, the apex of which constitutes the closest point on the surface means 18 to the nozzle 14. The term "cone" is not used in its mathematical sense which requires straight sides; instead, the sides of the cone 38 may curve if desired either concavely or convexly as shown. The surface means 18, as shown, provides essentially four shallow troughs extending downwardly and outwardly from the base of the cone 38. The four troughs are arranged in annularly balanced fashion about the cone 38 in two pairs of essentially oppositely oriented troughs of identical configuration, indicated generally by the numerals 40 and 42.

Figure 2:
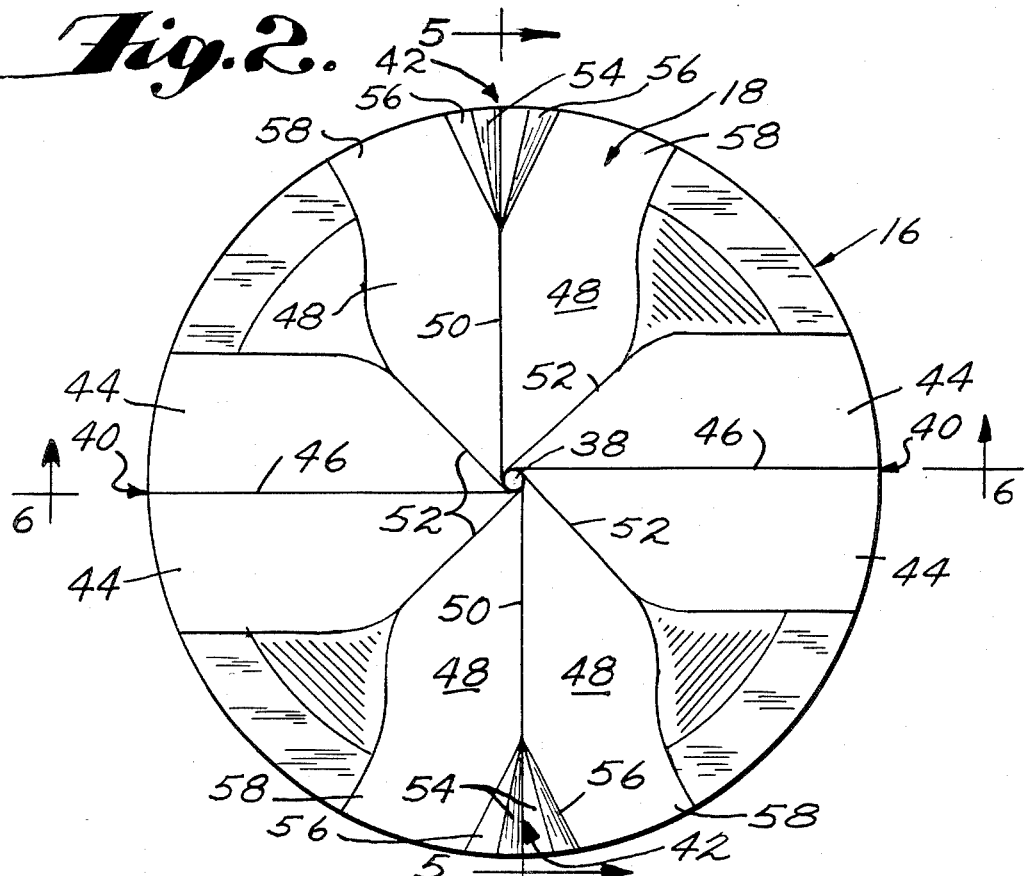
FIG. 2 is a top plan view of the rotary distributor shown in FIG. 1 embodying the principles of the present invention.
Figure 3:
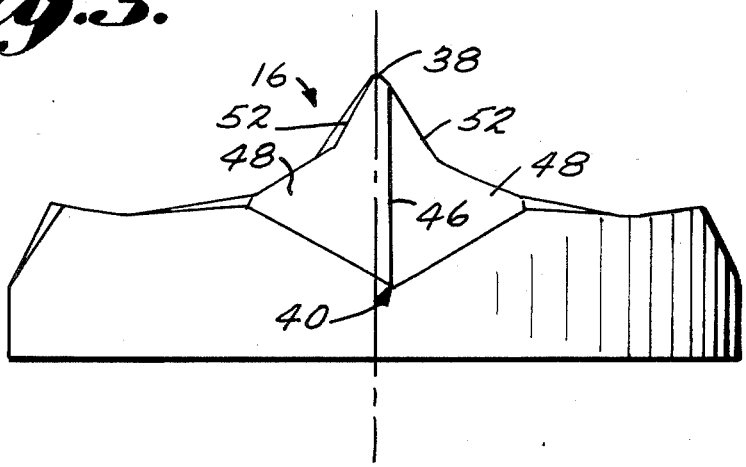
FIG. 3 is a side elevational view of the rotary distributor shown in FIG. 2.
Figure 4:
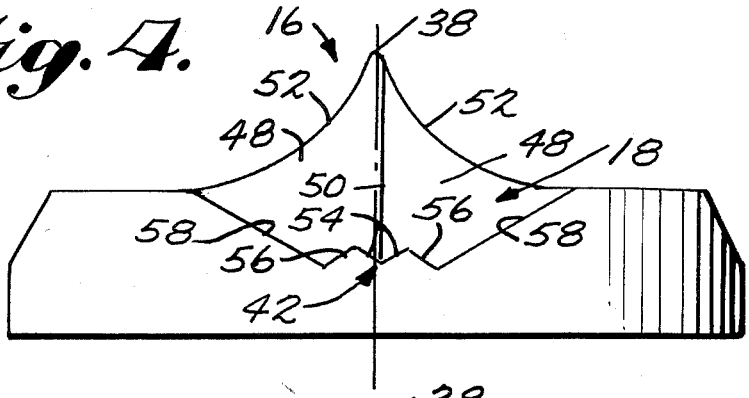
FIG. 4 is a front elevational view of the rotary distributor shown in FIG. 2.
Figure 5:
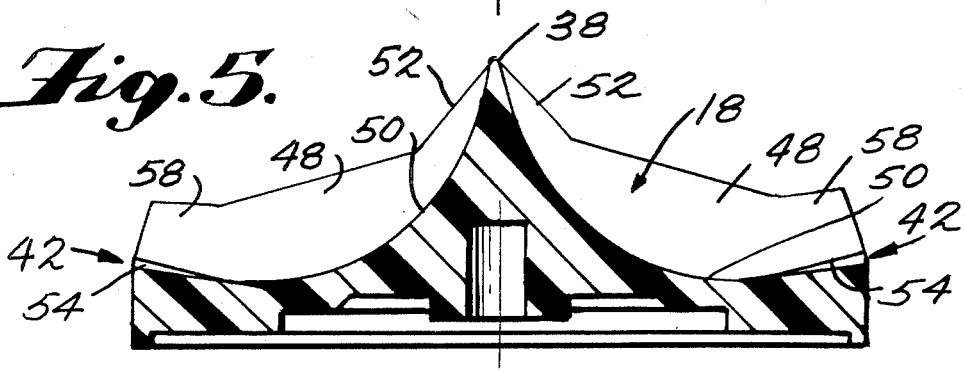
FIG. 5 is a sectional view of the rotary distributor taken along the line 5—5 of FIG. 2.

Each trough 40 is preferably of shallow V-shaped configuration in cross-section being defined by a pair of side wall surfaces 44 intersecting along a trough bottom line 46. As best shown in FIG. 2, each trough bottom line 46 when viewed in plan from the top extends substantially straight from the base of the cone 38 to the periphery of the rotary distributor 16. Each pair of side wall surfaces 44 is generally symmetrical about a vertical plane passing through the trough bottom line 46. While a constant shallow V-shape cross-sectional configuration is preferred a shallow U could be utilized. The constant slope symmetrical arrangement is preferred because it causes less deviation in the flow of water along a path defined by the trough bottom line 46.

Figure 6:
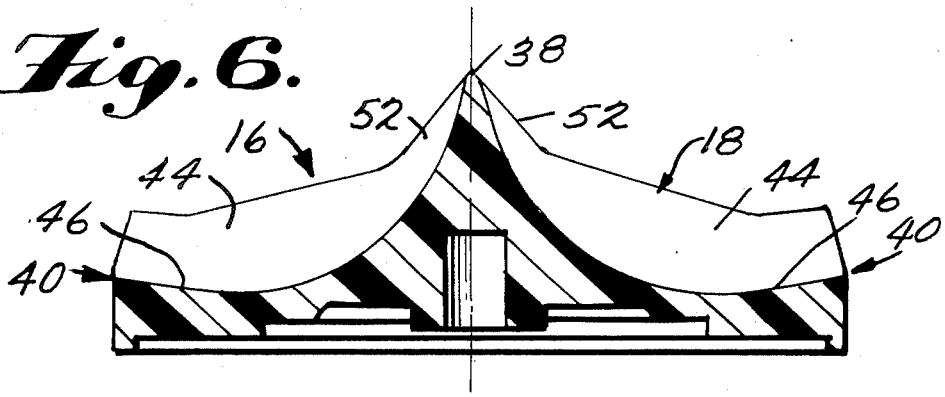
FIG. 6 is a sectional view taken along the line 6—6 of FIG. 2.

As best shown in FIG. 6, each trough bottom line 46 curves downwardly and outwardly from the position adjacent the cone 38. The downward and outward curvature, which is concave in a direction facing the nozzle 14, reaches horizontal and then continues smoothly in an upward and outward direction with an issuing curvature which is approximately 10° from the horizontal.

The troughs 42 are similar to the troughs 40, each being defined by a pair of side wall surfaces 48 which intersect along a trough bottom line 50. It is important to note that each side wall surface 48 intersects an adjacent side wall surface 44 along a relatively sharp stream separating edge 52. These edges 52 are straight when viewed in plan and extend from the base of the cone 38 tangentially for an extent which is greater than the radius of the greatest nozzle size. Each stream separating edge 52 when viewed in a vertical plane passing therethrough extends downwardly and outwardly from the base of the cone 38. The configuration of each trough bottom line 50 and associated side wall surfaces 48 are identical to the configuration of the trough bottom line 46 and side wall surfaces 44 except at their outer end portions. The outer end curvature of each trough bottom line 50 issues at a 7° angle. In addition, a pair of opposed angularly related relatively small triangularly shaped surfaces 54 extend from the side wall surfaces 48 at the outer end portion of each trough bottom line 50. A complementary surface 56 extends from each triangularly shaped surface 54 back to an associated side wall surface portion 58 which extends in a direction laterally the same angle as the associated side wall surface 48 but is relieved in the outward direction so as to allow the water issuing therefrom to have a smaller angular inclination from the horizontal. The surfaces 54, 56 and 58 function to cause the water issuing therefrom to be spread out laterally somewhat and to be distributed closer to the distributor axis of rotation. The resultant overall distribution pattern is more uniform and reduces the doughnut shaped distribution pattern which would result if all four streams coming from the distributor were like the streams issuing from the troughs 40.

The speed reducing assembly 20 is preferably constructed in accordance with the teachings of U.S. Pat. No. 4,660,766. As best shown in FIG. 1, the speed reducing assembly 20 includes a cup shaped housing member 60 which is fixed within a cylindrical mounting portion 36 of the sprinkler body 12, as by a lock washer 62. The end wall of the cup shaped housing member 60 is apertured to receive one end of a shaft 64, the opposite end of which is connected with the distributor 16. Fixed to the shaft 64 above its lower end is an enlarged fluid damping rotor 66. A, ball bearing 68 serves to rotatably mount the portion of the shaft 64 extending above the rotor 66. A flexible lip seal 70 is mounted above the ball bearing 68 in a position to engage the periphery of the shaft 64 thereabove. The entire interior of the cup shaped housing is filled with hydraulic fluid 72. Speed retardation is accomplished in accordance with the teachings of the aforesaid patent, by the frictional contact between the hydraulic fluid 72, the moving rotor 66 and fixed housing member 60.

Figure 7:
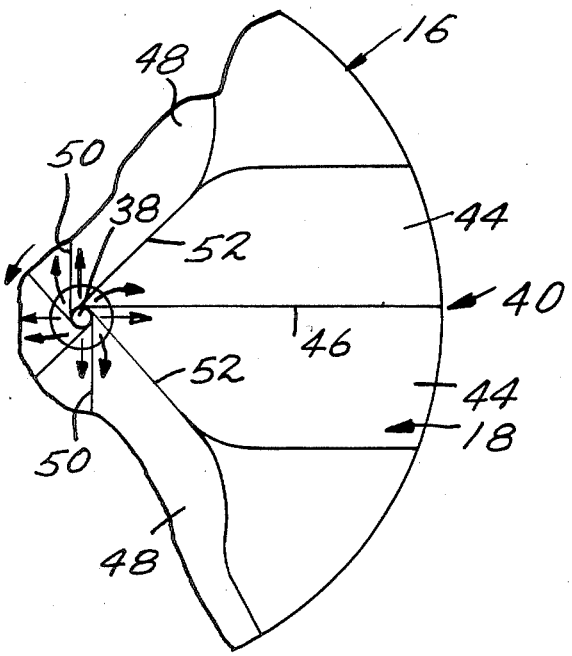
FIG. 7 is a fragmentary top plan view of the rotary distributor illustrating schematically the reactionary forces acting on the rotary distributor when a nozzle of a relatively small size is utilized in the sprinkler head.
Figure 8:
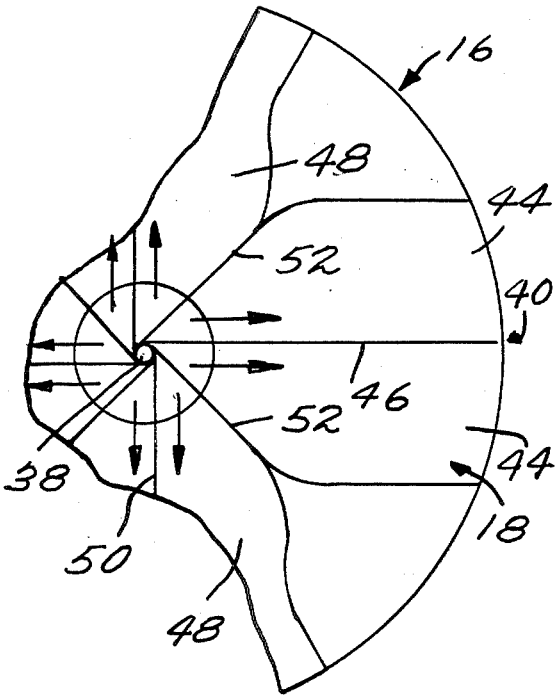
FIG. 8 is a view similar to FIG. 7 schematically illustrating the reactionary forces when a relatively large size nozzle is utilized in the sprinkler head.

FIGS. 7 and 8 graphically illustrate the reactionary forces which are applied to the distributor 16 when a nozzle of minimum size is selected, as in FIG. 7, and a nozzle of maximum size is selected, as in FIG. 8. With reference to FIG. 7, it will be noted that the cone 38 engages a substantial portion of the stream so that the stream becomes an annulus having both a downward component of movement and a radially outward component of movement. As the stream progressively engages the relatively sharp separating edges 52, the annulus is divided into four separate streams. Each of these streams impinges upon side wall surfaces 44 or 48. Since the leading side wall surface changes the direction of radial movement of each separated stream more than the associated trailing side wall surface, a reactionary force is created which has a net component tangential to the rotational axis. The sum of these net tangential reactionary forces causes the distributor to turn in a counterclockwise direction as viewed in FIG. 7.

Each separated stream is directed outwardly along the associated trough in an outward direction which essentially follows the trough bottom line 46 or 50 which, as shown in FIG. 7, is tangential and straight in plan. As the associated side wall surfaces turn the water from a downward and outward direction progressively to a horizontally outward direction, the resultant force of this change of direction likewise has a tangential component which acts essentially along the associated trough bottom line. As the water moves outwardly beyond the horizontal outward direction, it is directed slightly upwardly, as previously indicated, which establishes a negative tangential reactionary force offsetting a portion of the net tangential reactionary force previously described. Since the outer end portions of all of the troughs are symmetrical, there is no horizontal tangential reactionary force component created. In this way, since most of the tangential reactionary forces are imposed on the distributor in the vertical plane close to the rotational axis, the lever arm through which the reactionary forces act is relatively small so that changes in the energy level of the stream by virtue of a greater flow rate at a substantially constant pressure will not substantially increase the torque tending to rotate the distributor. With reference to FIG. 8, it can be seen that, as the size of the primary stream increases, the incremental annular portions which are added tend to contact the side wall surfaces 44 or 48 so as to be directed outwardly along the tangent lines represented by the trough bottom lines 46 or 50. In actual practice, a 16/128 inch diameter nozzle accomplishes one revolution in approximately 34 seconds. A 44/128 inch diameter nozzle increases in speed somewhat, but only slightly, to approximately 24 seconds for one revolution.

Moreover, this compensation for increases in flow rate by increasing nozzle size is accomplished with a surface means 18 which defines surface shapes devoid of extended shapes disposed in directions facing toward the instantaneous direction of water flow contacted thereby so as to minimize the possibility of extraneous debris and/or debris within the streams from hanging up on the distributor and detrimentally altering the desired water distribution pattern thereof. The gentle nonsevere slopes of the surface shapes also materially aid in the wear characteristics of the distributor.

Figure 9:
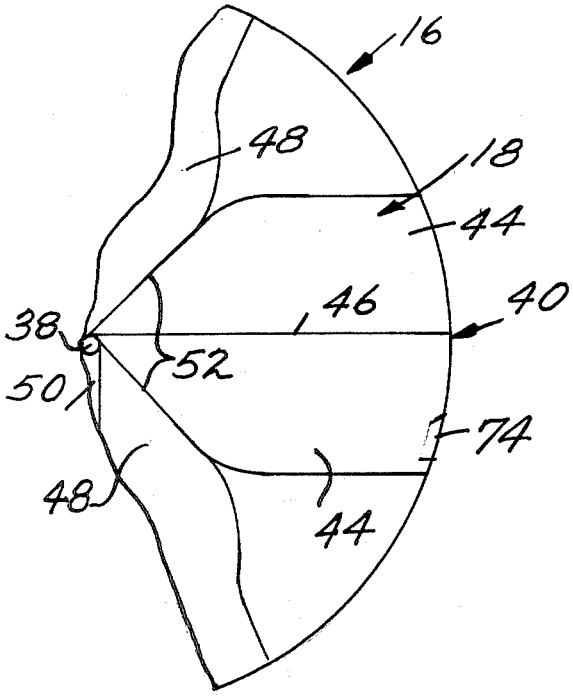
FIG. 9 is a view similar to FIG. 7 illustrating a modified construction which can be utilized for preventing increases in response to increases in the nozzle size utilized.
Figure 10:
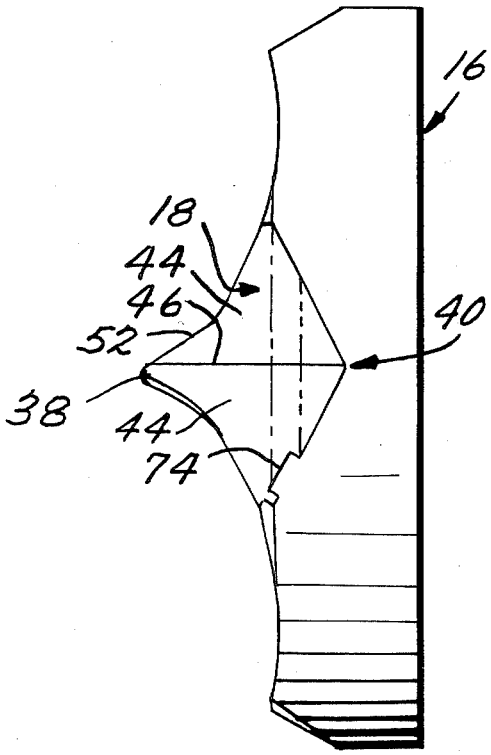
FIG. 10 is a side elevational view of the rotary distributor shown in FIG. 9.

While a slight increase in speed to the extent exemplified above is considered permissible, FIGS. 9 and 10 illustrate a modification which would enable the distributor 16 to operate at a more constant speed level throughout the range of nozzle size changes. The distributor 16 shown in these two figures is identical with the distributor 16 previously described except that, on the outer end portion of the trailing side wall surface of each trough 40, there is formed a small decelerating reactive surface portion 74 in spaced relation to the trough bottom line 46. As shown in phantom lines in FIG. 10, where relatively small nozzle sizes are utilized, the water within each trough 40 will be below the surface portion 74 so that it does not affect the reactionary force components. As the larger size nozzles are utilized, the level of the water within each trough 40 will rise. The engagement of the incremental increased level of the water with the surface portion 74 creates a reactionary force which has a tangential component opposite from the net tangential component of the associated trough. Hence, there is provided a tendency for the distributor not to increase in speed as the higher nozzle sizes are selected for use.

Figure 11:
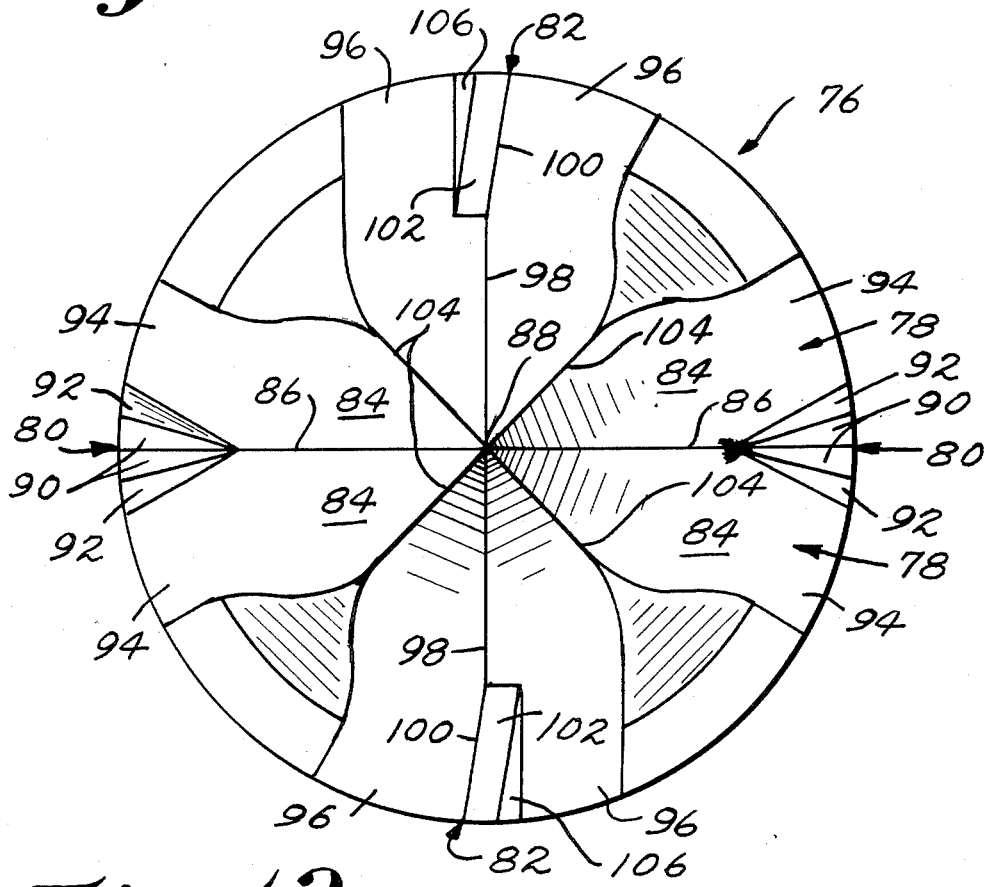
FIG. 11 is a top plan view of another form of rotary distributor utilized with the sprinkler head shown in FIG. 1.
Figure 12:
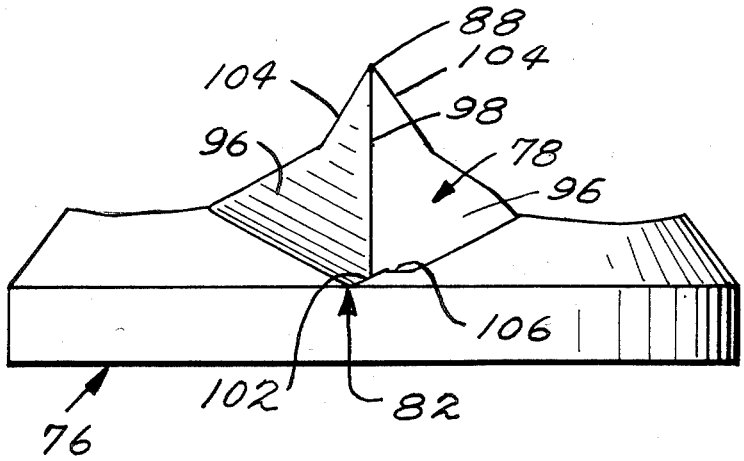
FIG. 12 is a front elevational view of the rotary distributor shown in FIG. 11.
Figure 13:
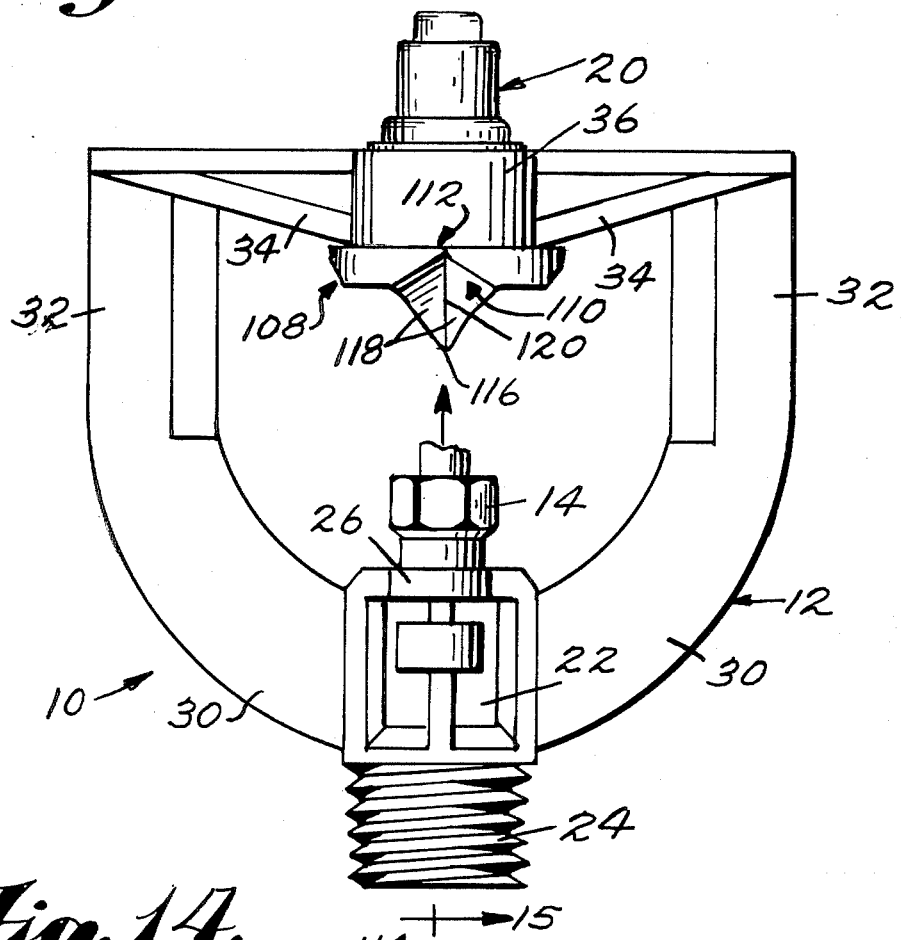
FIG. 13 is a view similar to FIG. 1 illustrating another embodiment of a rotary distributor embodying the principles of the present invention which can be utilized with the components shown in FIG. 1 when the latter are inverted for operation in which the primary stream is directed upwardly rather than downwardly.
Figure 14:
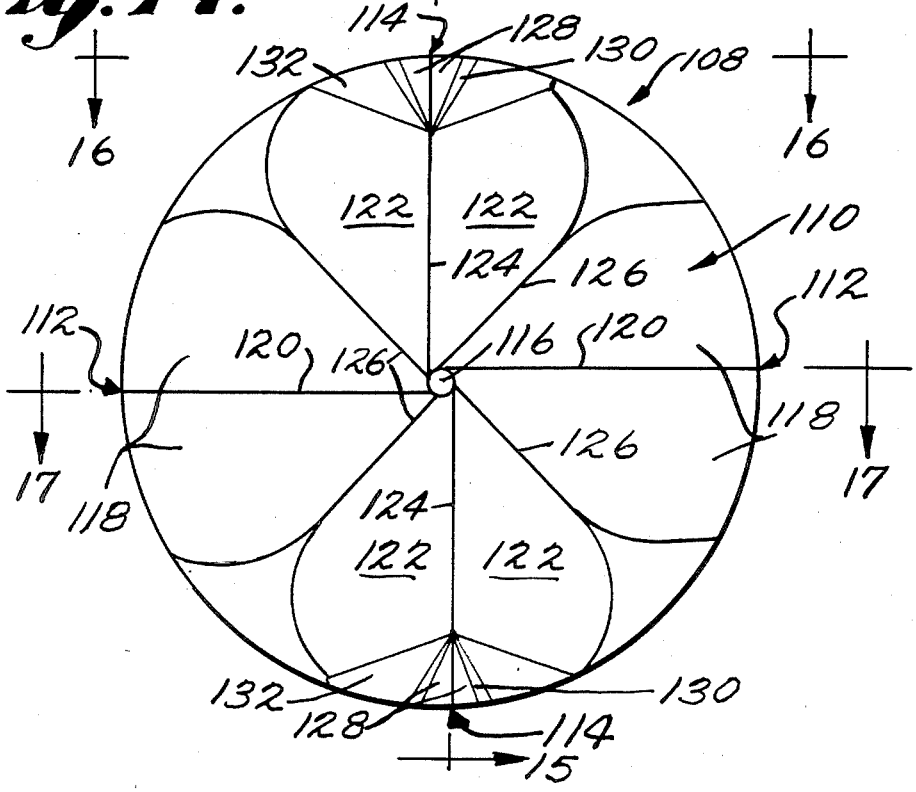
FIG. 14 is a bottom plan view of the rotary distributor shown in FIG. 13.
Figure 15:
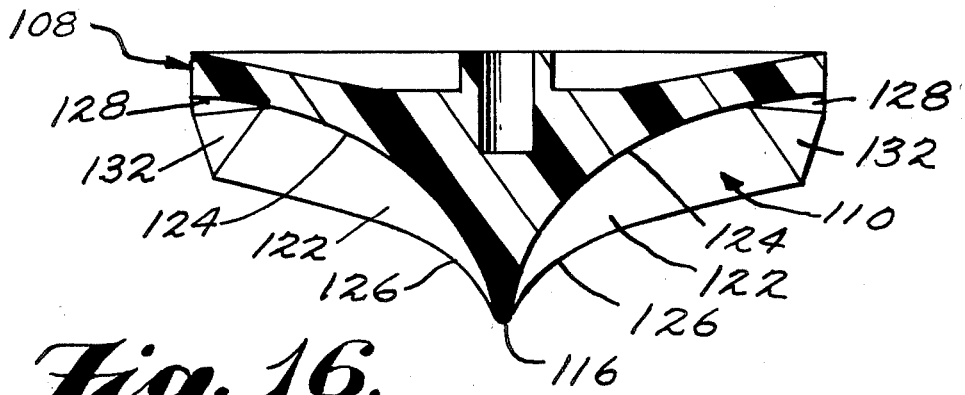
FIG. 15 is a sectional view taken along the line 15—15 of FIG. 14.
Figure 16:
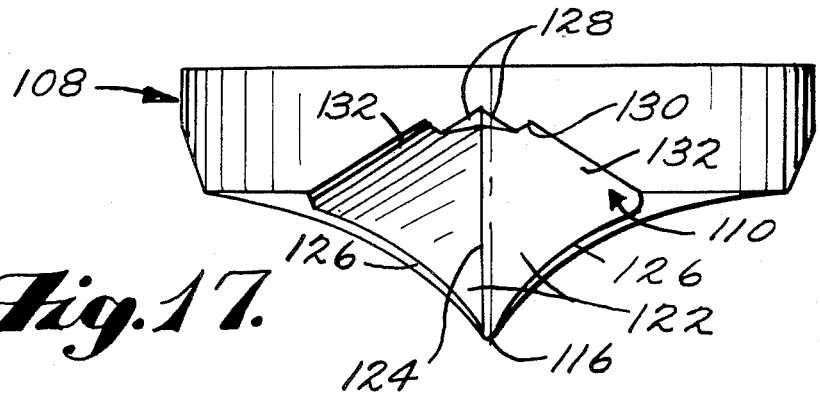
FIG. 16 is an elevational view taken along the line 16—16 of FIG. 14.

FIGS. 11 and 12 illustrate another embodiment of a rotary distributor, generally indicated at 76, embodying the principles of the present invention. The distributor 76 includes surface means, generally indicated at 78, for dividing the primary stream into four separate streams and directing the streams outwardly to accomplish the same functions previously described. As before, the surface means provides four shallow troughs which include one pair of oppositely directed troughs 80 of identical construction and a second pair of oppositely directed troughs 82 of identical construction but different from the construction of the troughs 80.

Each trough 80 is defined by side wall surfaces 84 intersecting along a trough bottom line 86. The side wall surfaces 84 and trough bottom line 86 are configured identically as in the troughs 42 previously described except that each trough bottom line 86 extends radially outwardly from a center peak 88 of the surface means 78 rather than tangentially from the base of a cone. As before, the outer end portions of each pair of side wall surfaces 84 include a pair of triangular surface portions 90 and 92 and a relieved surface portion 94.

Each trough is defined by side wall surfaces 96 and a trough bottom line 98 which bears a generally similar relationship with the configuration of the troughs 40 except that, in addition to the radial extent of the trough bottom line 98, the outer end portion of the trough bottom line is angulated as indicated at 100 and the side wall surfaces are modified to include an offset driving surface portion 102 which extends a short distance up the leading side wall surface 96 from the angulated trough bottom line end portion 100. With this radial disposition of the trough bottom lines 86 and 98, stream dividing edges 104 are formed which likewise extend radially outwardly.

The lateral or annular extent of each driving surface portion 100 is such that when the smallest size nozzle 14 within the range is selected the water in the stream associated with each trough 82 will have its upper level at the level of a triangular horizontal surface portion 106 extending from the driving surface portion 104 to the leading side wall surface 96.

In the operation of the distributor 76, the stream is initially divided into four streams in a symmetrical fashion by the edges 104 and then directed radially outwardly in symmetrical fashion by the sidewall surfaces 84 and 96. Hence, there are no tangential reactionary force components created until driving surface portions 102 are engaged. Since the reactionary tangential force components thus created act through a relatively large lever arm an equivalent torque is generated near the periphery to that generated near the axis of rotation on the distributor 16 of FIGS. 1–6. Moreover, it will be noted that as the size of the selected nozzle increases, the net tangential reactionary force does not substantially increase since the area of the driving surface portion 104 contacted by water does not increase. It will be understood that a torque diminishing reactionary surface portion similar to the surface portion 74 of FIGS. 9 and 10 could be utilized. It will also be understood that the tangential component reactionary surface portions 74 and 106 while shown to be at a constant angle could be made of varying angularity so as to blend more smoothly into the associated side wall surface. It is important to note that, in all embodiments, the separated stream integrity is maintained immediately after primary stream division by directing the same along a straight line when viewed in plan for most of the separate stream movement in contact with the distributor surface means.

Figure 17:
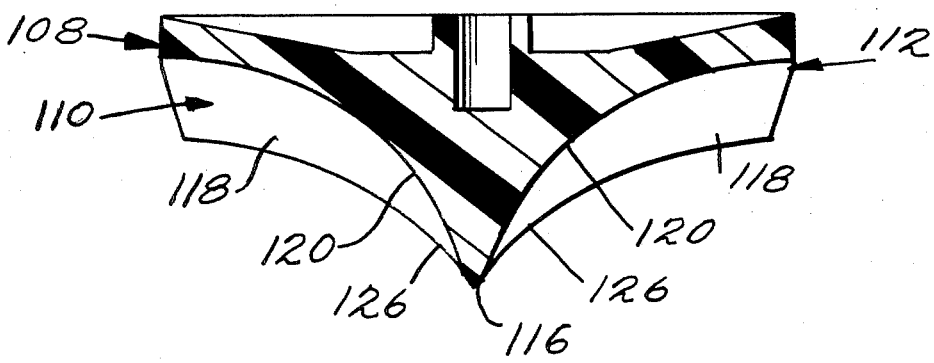
FIG. 17 is a sectional view taken along the line 17—17 of FIG. 14.

In the embodiments of the invention thus far described, the sprinkler body 12 of the rotary sprinkler head 10 is oriented during operation so that the primary stream flows vertically downwardly. This orientation is representative of drop tube or boom mountings in pivot or lateral move systems. FIGS. 13–17 are representative of sprinkler head mountings directly on top of the main pipe or boom in pivot move or lateral move systems. Essentially, the sprinkler body is simply inverted so that the primary stream issues in an upward direction rather than in a downward direction. In the embodiment shown in FIG. 13, a rotary distributor, generally indicated at 108, has been provided which accommodates this difference. The distributor 108 includes surface means 110 which is patterned closely after the surface means 18 of distributor 16 shown in FIGS. 1–6. As shown, the surface means 110 defines two pairs of troughs 112 and 114 extending from the base of a relatively small central cone 116. Each of the troughs 112 are defined by side wall surfaces 118 intersecting along a trough bottom line 120. The side wall surfaces 118 and trough bottom line 120 are configured like the side wall surfaces 44 and trough bottom line 46 previously described except that the curvature of the trough bottom line 120 in the vertical plane passing therethrough does not extend to a full horizontal direction of component but rather ends with a curvature of approximately 10° to the horizontal, as best shown in FIG. 17, so that the stream issuing therefrom is at an angle of approximately 10° to the horizontal.

Each trough 114 is formed by side wall surfaces 122 intersecting at a trough bottom line 124 in a manner similar to side wall surfaces 48 and trough bottom line 50 except for a similar accommodation at the outer end portion of the side wall surfaces 122. Thus, side wall surfaces 122 intersect with side wall surfaces 118 to form tangentially extending stream dividing edges 126. Similarly, a triangular surface portion 128 is formed in each side wall surface 122 alongside the outer end portion of the trough bottom line 124 and a complementary triangular surface portion 130 and relieved surface portion 132 are provided in association with each triangular surface portion 128. The operation of the distributor 108 is similar to that of the distributor 16 shown in FIGS. 1–6, except that the four divided streams are simply curved upwardly and outwardly to issue from the distributory in the same fashion rather than downwardly and outwardly and then upwardly and outwardly as is the case with distributor 16.

It thus will be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A rotary sprinkler head comprising a sprinkler body having an outlet and means devoid of any operative dynamic seals for communicating a source of water under pressure with said outlet, said outlet being defined by a nozzle for directing water under pressure communicated therewith into an atmospheric condition in a primary stream having a generally vertically extending axis, a rotary distributor mounted for rotational movement about a generally vertical rotational axis with respect to said sprinkler body in engaging relation with respect to the primary stream directed from said nozzle, said rotary distributor having surface means for receiving the primary stream, dividing the primary stream into a plurality of horizontally separated streams, each having a major vertical component of movement and a minor horizontal component of movement, and directing the separated streams while retaining the integrity of the streams in a plurality of generally circumferentially balanced directions outwardly of the vertical axis of the primary stream so that (1) the separated streams leave the distributor surface means with a minor vertical component and a major horizontal component of stream movement and (2) the change in the components of movement of the streams create reactionary forces having net components acting tangentially to the axis of rotation of the distributor which do not increase substantially with increases in flow rates under constant pressure conditions thereby enabling said distributor to operate with a relatively narrow range of rotational speed changes within a relatively wide range of nozzle size changes, and speed reducing means operatively associated with said distributor for reducing the rotational speed of the distributor resulting from the net tangential components of the reactionary forces from a relatively high whirling speed which would occur without said speed reducing means to a relatively slow speed so related to the distributor surface means forming the pattern forming stream means as to permit said plurality of streams to leave said distributor surface means with sufficient stream integrity to flow outwardly a distance substantially as great as the same streams would flow if the distributor were held stationary.

2. A sprinkler head as defined in claim 1 wherein said distributor surface means defines surface shapes devoid of extended shapes disposed in directions facing toward the instantaneous direction of water flow contacted thereby so as to minimize the possibility of extraneous debris and/or debris within the streams from hanging up on said distributor and detrimentally altering the desired water distribution pattern thereof.

3. A sprinkler head as defined in claim 2 wherein said distributor surface means defines at least three separate stream directing troughs each including side wall surfaces intersecting along a trough bottom line, each trough bottom line when viewed in plan being substantially straight and extending substantially tangentially from a position close to the distributor axis of rotation, the side wall surfaces of each trough being generally symmetrical with respect to a vertical plane passing through the associated trough bottom line.

4. A sprinkler head as defined in claim 3 wherein adjacent side wall surfaces of adjacent troughs intersect along a primary stream dividing edge, each primary stream dividing edge when viewed in plan extending substantially straight tangentially from a position close to the distributor axis of rotation.

5. A sprinkler head as defined in claim 4 wherein each primary stream dividing edge when viewed in a vertical plane passing therethrough curves from said position close to the distributor axis of rotation with a concavity facing toward said nozzle.

6. A sprinkler head as defined in claim 5 wherein each trough bottom line when viewed in said vertical plane passing therethrough curves from said position close to the distributor axis of rotation with a concavity facing toward said nozzle.

7. A sprinkler head as defined in claim 6 wherein said primary stream moves upwardly along its vertical axis and each trough bottom line curves concavely arcuately upwardly and outwardly such that the associated stream leaves the associated trough in an upwardly and outwardly extending direction.

8. A sprinkler head as defined in claim 7 wherein the curvature of each trough is such that the upward and outward extent of the associated stream leaving the same is of the order of 10° with respect to the horizontal.

9. A sprinkler head as defined in claim 6 wherein said primary stream moves downwardly along its vertical axis and each trough bottom line curves concavely arcuately downwardly and outwardly so that the associated stream leaves the associated trough in an upwardly and outwardly extending direction.

10. A sprinkler head as defined in claim 9 wherein the curvature of each trough is such that the upward and outward extent of the associated stream leaving the same is of the order of 10° with respect to the horizontal.

11. A sprinkler head as defined in claim 6 wherein the surface means defining certain of said troughs includes outwardly disposed stream modifying surfaces for partially disrupting the integrity of the associated stream in a manner so as to cause the water thereof to be distributed more densely in the area of the circular pattern nearer the pattern center than the water of other streams.

12. A sprinkler head as defined in claim 11 wherein said outwardly disposed stream modifying surfaces include a first pair of opposed angularly related relatively small triangularly shaped surfaces extending from the side wall surfaces at the outer end portion of the trough bottom line and complementary surfaces extending from said triangularly shaped surfaces back to the associated side wall surfaces.

13. A sprinkler head as defined in claim 12 wherein the distributor surface means defining certain of said troughs include relatively small, smooth speed reducing water reactant surfaces on the outer end portion of one side wall surface in spaced relation to the associated trough bottom line so as to be contacted by water only when relatively larger nozzle sizes within the range of nozzle size changes are utilized.

14. A sprinkler head as defined in claim 1 wherein the portions of said distributor surface means which receive the primary stream and divide the primary stream into the plurality of horizontally separated streams define a central point along the vertical axis of rotation constituting the closest surface to said nozzle means and a plurality of relatively sharp edges facing toward said nozzle having innermost ends disposed closely adjacent said central point, each of said plurality of relatively sharp edges extending continuously and smoothly from the innermost end thereof in a direction away from said nozzle and away from the vertical axis of rotation.

15. A sprinkler head as defined in claim 1 wherein said distributor surface means defines at least three separate stream directing troughs each including side wall surfaces intersecting along a trough bottom line, each trough bottom line when viewed in plan extending substantially straight and substantially tangentially from a position close to the distributor axis of rotation, the side wall surfaces of each trough being generally symmetrical with respect to a vertical plane passing through the associated trough bottom line, the adjacent side wall surfaces of adjacent troughs intersecting to form said relatively sharp edges.

16. A sprinkler head as defined in claim 15 wherein the surface means defining a pair of oppositely disposed troughs includes surfaces at the outward positions of the associated troughs for partially breaking up the integrity of the associated pair of streams in a manner so as to cause the water thereof to be distributed more densely in the area of the circular pattern nearer the center than the water of the remaining two streams.

17. A sprinkler head as defined in claim 16 wherein said outwardly disposed stream modifying surfaces include a first pair of opposed angularly related relatively small triangularly shaped surfaces extending from the side wall surfaces at the outer end portion of the trough bottom line and complementary surfaces extending from said triangularly shaped surfaces back to the associated side wall surfaces.

18. A sprinkler head as defined in claim 17 wherein the distributor surface means defining certain of said troughs include relatively small, smooth speed reducing water reactant surfaces on the outer end portion of one side wall surface in spaced relation to the associated trough bottom line so as to be contacted by water only when relatively larger nozzle sizes within the range of nozzle size changes are utilized.

19. A sprinkler head as defined in claim 15 wherein the distributor surface means defining certain of said troughs include relatively small, smooth speed reducing water reactant surfaces on the outer end portion of one side wall surface in spaced relation to the associated trough bottom line so as to be contacted by water only when relatively larger nozzle sizes within the range of nozzle size changes are utilized.

20. A sprinkler head as defined in claim 2 wherein said distributor surface means defines at least three separate stream directing troughs each including side wall surfaces intersecting along a trough bottom line, each trough bottom line when viewed in plan extending substantially straight and substantially radially from a position at the distributor axis of rotation, the side wall surfaces of each trough being generally symmetrical with respect to a vertical plane passing through the associated trough bottom line, at least one of said troughs having a non-symmetrical surface portion on one side wall surface operable to create a net reactionary component acting tangentially to the axis of rotation of the distributor, each non-symmetrical surface portion being positioned adjacent the associated trough bottom and extending from said trough bottom line along the one side wall surface an extent approximately the same as the extent of the one side wall surface contacted when a nozzle of minimum size within said range is utilized to define said outlet.

21. A sprinkler head as defined in claim 1 wherein said distributor surface means defines at least three separate stream directing troughs each including side wall surfaces intersecting along a trough bottom line, each trough bottom line when viewed in plan extending substantially straight and substantially radially from a position at the distributor axis of rotation, the side wall surfaces of each trough being generally symmetrical with respect to a vertical plane passing through the associated trough bottom line, at least one of said troughs having a non-symmetrical surface portion on one side wall surface operable to create a net reactionary component acting tangentially to the axis of rotation of the distributor, each non-symmetrical surface portion being positioned adjacent the associated trough bottom and extending from said trough bottom line along the one side wall surface an extent approximately the same as the extent of the one side wall surface contacted when a nozzle of minimum size within said range is utilized to define said outlet.

22. A rotary sprinkler head comprising a sprinkler body having an outlet and means devoid of any operative dynamic seals for communicating a source of water under pressure with said outlet, said outlet being defined by surface means for directing water under pressure communicated therewith into an atmospheric condition in a primary stream having a generally vertically extending axis, a rotary distributor mounted for rotational movement about a rotational axis with respect to said sprinkler body in engaging relation with respect to the primary stream directed from said outlet, said rotary distributor having surface means for engaging the primary stream (1) to establish a reactionary force component acting on said distributor in a direction tangential to the rotational axis thereof so as to effect rotational movement thereof about said axis of rotation and (2) to direct the primary stream engaged thereby in the form of pattern forming stream means including at least one stream moving away from said distributor in a direction having a substantial component extending radially outwardly from the generally vertical axis of said primary stream, speed reducing means operatively associated with said distributor for reducing the rotational speed of the distributor resulting from said reactionary force component from a relatively high whirling speed which would occur without said speed reducing means to a relatively slow speed so related to the distributor surface means forming the pattern forming stream means as to permit (1) said one stream to leave said distributor surface means with sufficient stream integrity to flow outwardly a distance substantially as great as the same said one stream would flow if the distributor were held stationary and (2) all of the pattern forming stream means including said one stream to be distributed within a generally circular pattern with a desired droplet size and with a desired water distribution within said generally circular pattern being defined by the maximum extent of flow of said one stream, the improvement which comprises the surface means defining said outlet being provided by a selected one of a series of different nozzles defining different size outlets within a relatively large range of different sizes, said distributor surface means being operable to establish a reactionary force component acting on said distributor in a direction tangential to the rotational axis thereof so as to effect rotational movement at a predetermined speed when the selected nozzle defines an outlet of minimum size within said range and the water under pressure communicated with said outlet is at a predetermined operative value, said distributor surface means being operable to limit the amount of increase in the established reactionary force component acting on said distributor in a direction tangential to the rotational axis thereof when the selected nozzle defines an outlet of maximum size within said range and the water under pressure communicated with said outlet is at said predetermined operative value so as to limit the increase in the effected rotational speed with respect to said predetermined speed to one wherein said one stream flows outwardly a distance substantially as great as the same said one stream would flow if the distributor were held stationary.

* * * * *